United States Patent [19]

Schueler et al.

[11] 4,221,498

[45] Sep. 9, 1980

[54] ROADSIDE BARRIER REFLECTOR

[75] Inventors: Arthur P. Schueler, Schaumburg; Robert I. Nagel, Skokie, both of Ill.

[73] Assignee: Astro Optics Corporation, Schaumburg, Ill.

[21] Appl. No.: 36,753

[22] Filed: May 7, 1979

Related U.S. Application Data

[63] Continuation-in-part of Ser. No. 856,967, Dec. 2, 1977, Pat. No. 4,123,181, which is a continuation of Ser. No. 876,174, Feb. 8, 1978, abandoned.

[51] Int. Cl.[2] ..... E01F 9/00

[52] U.S. Cl. ..... 404/9; 404/16; 116/63 R; 40/594; 40/612

[58] Field of Search ..... 404/9, 15, 16, 14, 10; 40/594, 612; 116/63 R

[56] References Cited

U.S. PATENT DOCUMENTS

| | | | |
|---|---|---|---|
| 2,318,722 | 5/1943 | Smith | 404/9 X |
| 2,329,171 | 9/1943 | Russ | 404/9 |
| 2,330,096 | 9/1943 | Waters | 404/9 X |
| 3,179,009 | 4/1965 | Sheffield | 404/16 X |
| 3,485,148 | 12/1969 | Heenan | 404/16 X |
| 3,540,282 | 11/1970 | Kohler | 404/16 X |
| 3,901,614 | 8/1975 | Overacher | 404/16 |
| 3,905,679 | 9/1975 | Langenbach | 404/9 X |
| 3,905,680 | 9/1975 | Nagel | 404/9 X |
| 3,965,681 | 9/1975 | Nagel | 404/9 X |
| 4,000,882 | 1/1977 | Penton | 256/13.1 |
| 4,035,059 | 7/1977 | DeMaster | 404/9 X |
| 4,123,181 | 10/1978 | Schueler | 404/16 |

*Primary Examiner*—Nile C. Byers, Jr.
*Attorney, Agent, or Firm*—Hill, Van Santen, Steadman, Chiara & Simpson

[57] ABSTRACT

An improved roadside reflector assembly which when mounted alongside a road is continuously visible by retroreflected light by the driver of a vehicle moving along the road at night-time within a viewing angle of from about 0° to 60° relative thereto, where 0° extends substantially parallelly to a tangent to the road in the region where such reflector assembly is located. Also, such driver continuously sees retroreflected light at any given instant of time while approaching and passing a group of the reflector means so employed and so located, the individual such reflector means being longitudinally spaced from one another along such a road.

14 Claims, 11 Drawing Figures

Fig. 8
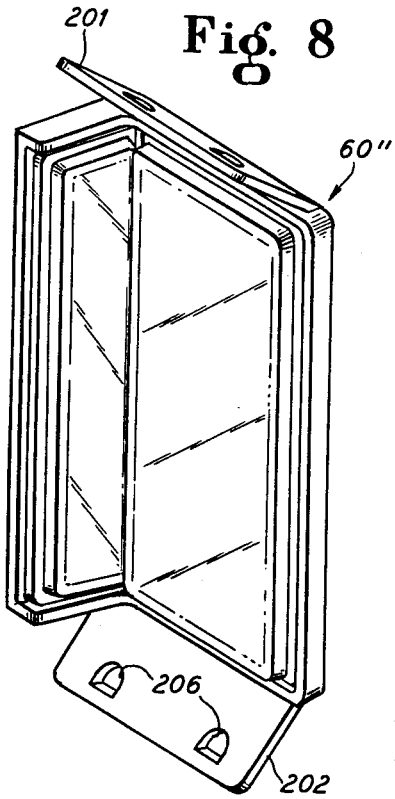
Fig. 9
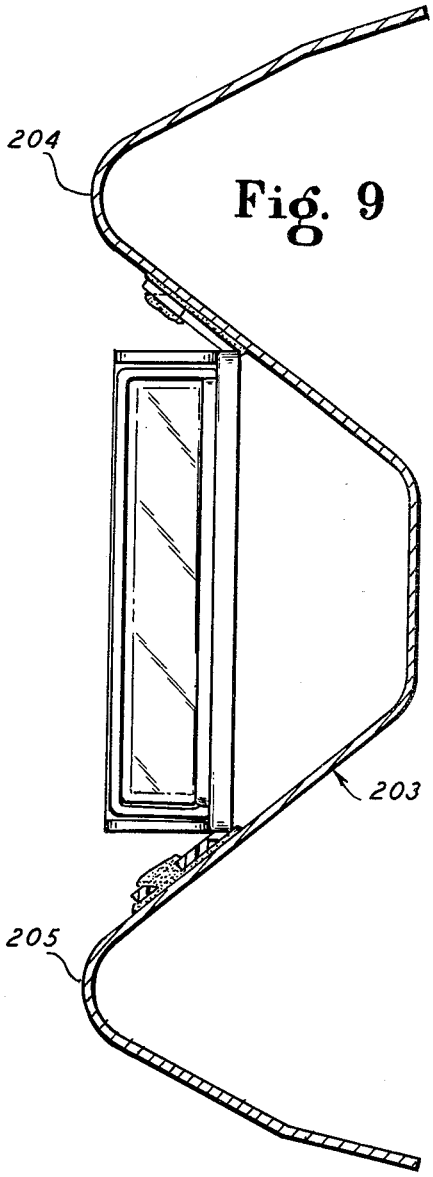
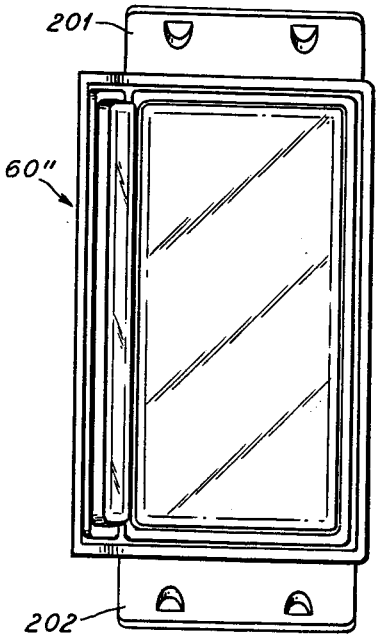
Fig. 10
Fig. 11
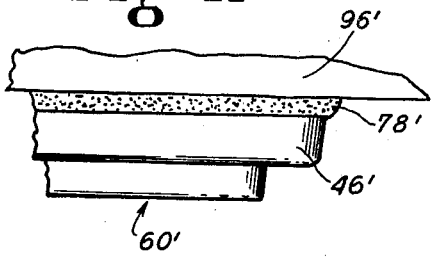

ROADSIDE BARRIER REFLECTOR

RELATED APPLICATION

This application is a continuation-in-part of our U.S. application Ser. No. 856,967, filed Dec. 2, 1977, now U.S. Pat. No. 4,123,181 the entire contents of which are incorporated herein by reference. This is a continuation of application Ser. No. 876,174, filed Feb. 8, 1978, now abandoned.

BACKGROUND OF THE INVENTION

In order to mark or delineate for visibility at night time by vehicle drivers road side edge portions (or road side edge barriers, or road median strips delineating the space interval between two adjacent highway surfaces running parallelly to one another, or curved exit or entrance ramps associated with so-called super highways and other roadways, or tunnels, or bridge structures, or any hazardous object along a road), vertically oriented reflectors have been employed. In general, three types of prior art reflectors have been employed for this type or class of application: (1) the prismatic triple mirror type reflector using a plurality of standard reflex type units wherein the individual cube axes are perpendicular to the surface of the reflector; (2) the glass bead-type reflector sheeting wherein glass beads are embedded thereinto; and (3) the prismatic triple mirror type reflector using a plurality of angled cube corner-type retroreflective units, such as a reflector adapted from the teachings of Heenan U.S. Pat. No. 3,332,327 which is normally mounted horizontally on the pavement as a center line marker or the like, but which, in this application, is mounted vertically and which here utilizes only the front ramp-like surface of such reflector body. In this class of application, the performance of all three of these reflectors is similar to one another in that the peak of retroreflectivity of each type in terms of light intensity when such is so mounted upon a road side edge or the like in a vertical orientation is parallel to a tangent to the road at that point. Retroreflectivity extends from that parallel position (sometimes termed 0°), or from such a peak intensity location, through typically angles up to about 25° to 30° into the roadway, although the glass bead-type reflector sheeting appears to have slightly more angular range than this, going up to perhaps about 40°.

In all known such prior art types of reflectors adapted for this class of application, the reflected light output, or performance of retroreflectivity, decreases with increasing angles to such tangent to the road. This decrease is such that, as a car moves down a roadway at night, for example, the driver has each individual road side reflector in view (as respects retroreflected light) only through a maximum angle typically not greater than about 30°. For the rest of the time interval that the driver is before, approaching and passing an individual reflector (which thus covers an angular range or zone of from about 30° to 90°), the driver is unable to see the individual reflector by retroreflected light because such reflector is not retroreflective of the car headlights in that zone. Perhaps the driver can physically see an individual such reflector, but once the driver is beyond 30°, and in the range of from 30° to 90°, he can not see or receive any retroreflected light signal therefrom.

There is a need for an improved roadside reflector means which will permit the drivers of vehicles to see individual roadside reflectors for a considerable distance along a road ahead. Such retroreflective viewability could be achieved by using individual reflector means each of whose retroreflectivity characteristics continuously extends at least from about 0° up to at least about 60° and which reflectors are stationed at spaced intervals along road side edge portions.

So far as is known, nothing in the prior art in any way teaches or suggests roadway edge marking reflector means adapted to provide appreciable, or practically sufficient, retroreflectivity beyond about 30° so that continuous retroreflectivity over zone of from about 30° to 60° is actually completely unachievable by prior art roadside reflector systems. Between about 30° and 40°, some retroreflectivity is possibly provided by glass beaded reflectors (for example, a glass beaded sheet the so-called "Scotch-Light" type (trademark) available from Minnesota Mining & Manufacturing Company, St. Paul, Minn.), but the 10° wide zone from 30° to 40° is found to be only weakly retroreflective for such glass beaded sheeting, so that the viewability and the retroreflectivity characteristics of glass beaded sheeting is generally considered by those skilled in the art of highway barrier marking to be insufficient for adequate highway safety practices at these angles of from 30° to 40°. Currently, glass beaded reflectors are accepted as a 0° to about 25° material, and very little use is made of the retroreflectivity characteristics of glass beads in the range of from about 25° to 40° because of this inherent weakness.

While, as indicated, no known individual reflector constructions adapted for this desired class of application have continuous retroreflective viewability characteristics over such ranges (relative to a road), cube corner type retroreflector constructions having retroreflective continuous viewability characteristics over a range of from about 0° to 70° (measured in the same relative direction as that herein used in reference to the present class of application) have heretofore been known to the prior art, but have been employed in, and constructed for, use in other fields of application. For examples, see Heenan et al U.S. Pat. No. 3,887,268, Heenan et al U.S. Pat. No. 3,541,606; Golden et al U.S. Pat. No. 3,887,268, Nagel U.S. Pat. No. 3,893,747; Nagel U.S. Pat. No. 3,894,786; Golden et al U.S. Pat. No. 3,894,790; Nagel U.S. Pat. NO. 3,895,855; Nagel U.S. Pat. No. 3,905,680; Nagel U.S. Pat. No. 3,905,681; and the like. Even when prior art reflectors have retroreflective capability through included angles greater than about ±30°, such are not directly adapted for use in the highway roadside marking field. For one thing, some of such prior art reflectors can have retroreflective characteristics which go so far beyond an included angle of 90° that they become safety hazards in that they could equally guide motorists approaching the same point from opposed directions. For another thing, some of such prior art reflectors, if mounted along a roadside, do not produce continuous retroreflectivity in the range from 0° to 60°; for example, if one endeavours to move a reflector of the type shown in Heenan U.S. Pat. No. 3,332,327 to an elevated position along the side of a road, one still does not obtain continuous retroreflectivity from such a reflector through an angle of from 0° to 60°. In the highway roadside or barrier marker field, reflector constructions specially adapted for positioning and mounting along road side edge portions are needed and necessary in order to permit economical installation, low maintenance costs, long life, good reflectance characteristics over the ranges desired (as above indicated), and the like. New and improved reflector constructions which are specially adapted for this class of application are thus needed.

BRIEF SUMMARY OF THE INVENTION

More specifically, the present invention relates to an improved reflector means of the cube-corner type which then suitably mounted along a roadside edge is adapted to be continuously visible by retroreflected light to drivers of vehicles moving along the road at night-time through a viewing angle of from about 0° to at least about 60°, but always less than about 90°.

Such reflector means utilizes two retroreflective regions. Each such region has a flattened exterior surface portion which is inclined angularly relative to the other thereof, and each such region is typically, though not necessarily, colored white, red, amber or blue. These two regions are interrelated in that they coact to continuously retroreflect incident light rays striking same over a predeterminable included angle which is at least about 60° but less than about 90° preferably measured outwardly from one such flattened exterior surface portion. Retroreflected light from such reflector means so colored at any given location within such included angle of about 60° to 90° preferably has a minimum specific intensity value for retroreflectivity which is at least that shown in the following Table 1 (for reasons of adequate viewability when such reflector means is installed along a roadway):

TABLE 1

| Color of such two regions | Specific intensity value in candelas per foot candle |
|---|---|
| White | 20 |
| Red | 5 |
| Amber | 12 |
| Blue | 5 |

In addition, the reflector means is provided with means for mounting and holding such reflector means in a predetermined orientation and in a predetermined location relative to a given roadway construction so that the following relationships are maintained:

1. One of such flattened exterior surface portions is generally vertical; and

2. One of such flattened exterior surface portions is so positionable relative to a road side edge portion, or to a longitudinally extending road surface portion, that, in relation to an included angle of 60°, 0° thereof extends substantially parallelly to a tangent to one of said road side edge portions (or to desired longitudinally extending road surface portions, as the case may be) in the region where each respective one of such reflector means is being positioned.

Preferably, and typically, such individual reflector means are located in an elevated relationship in longitudinally spaced relationship to one another along or adjacent surface portions of a given roadway construction, with median heights above road surface portions of from about 6 inches to 60 inches being typical.

The interrelationship between a plurality of reflector means mounted in longitudinally spaced relationship to one another along road surface portions is such that the driver of a vehicle moving along such road surface portions at night-time, such vehicle being equipped with headlight means, can continuously see by retroreflected light each individual reflector means within a viewing angle of from about 0° to at least about 60°, but less than 90°, where 0° extends substantially parallelly to a tangent to one of said roadside portions in the region where such reflector means is mounted, and where 60° and 90° and angles therebetween extend outwardly into such road surface portions from such a tangent. Preferably, such continues individual reflector viewability extends from about −5° to 75° at least.

A primary object of the present invention is to provide a new and improved reflector means for highway barrier marking which can be continuously seen by retroreflected light individually not only through angles of from about 0° to 25° or 30°, as in the prior art, but which can also be continuously seen at angles from about 25° to 30° up to at least about 60°, and which can preferably be so seen at angles of at least from about −5° to 75°, but always less than about 90°.

A further object is to provide an improved barrier marker reflector means which provides superior (relative to prior art) road delineation characteristics for both straight and curved vehicular roads, such reflector means being particularly well adapted for use with highway systems of the so-called modern super highway type having roadside barriers.

Another object of this invention is to provide a reflector means of the class indicated above which is simple, efficient, reliable, economical, and long lasting, and which is relatively flat.

Other and further objects, aims, purposes, features, advantages, modes, applications, variations, and the like will be apparent to those skilled in the art from the teachings of the present specification taken together with the drawings.

BRIEF DESCRIPTION OF DRAWINGS

In the drawings:

FIG. 8 is a perspective view of another embodiment of a reflector assembly of the present invention illustrating another alternative mounting means therefor;

FIG. 9 is a vertical sectional view taken through a roadway guard rail having mounted thereto an embodiment of FIG. 8;

FIG. 10 is a front elevational view of the embodiment of FIG. 8; and

FIG. 11 is a fragmentary view of another embodiment of a reflector assembly illustrating another alternative mounting means therefor.

DETAILED DESCRIPTION

Figure 1:
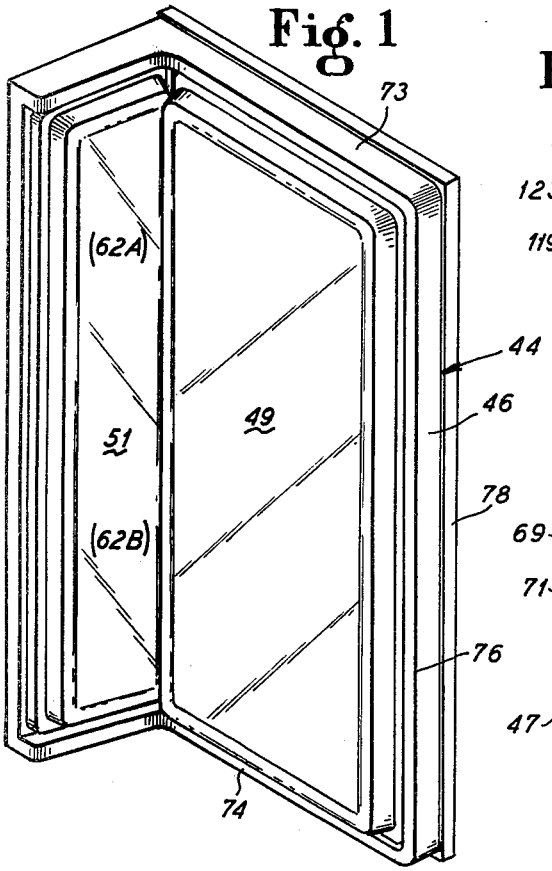
FIG. 1 is a perspective view of one embodiment of a reflector assembly of the present invention.

One exemplary embodiment of a reflector construction of the present invention is shown in FIGS. 1 through 4 and is designated in its entirety by the numeral 60. Reflector construction 60 is provided with a backing member 44 of integral one-piece rigid construction. The backing member 44 has a base portion 46 which is flattened and an inclined (relative to base portion 46) leg portion 47 which is likewise flattened. Leg portion 47 upstands at an inclined angle 55 along one edge 48 of the base portion 46. Angle 55 ranges from about 60° to 85°; and preferably from about 75° to 85°. In reflector 60, angle 55 is about 80° which is presently a most preferred inclination angle. The backing member 44 is preferably comprised of a molded thermoplastic or thermosetting plastic composition, such as one comprised of ABS, nylon, polyester, or the like, but alternatively may be formed of a sheet metal, or the like, as desired.

Reflector construction 60 incorporates two molded transparent retroreflective flattened rectangularly sided bodies 49 and 51 which can be comprised of a plastic, such as an acrylic or a polycarbonate resin. Each such body 49 and 51 has a flattened outer face 52 and 53 respectively, as well as an inner face 54 and 56, respectively, which is generally parallel to its respective outer face 52 and 53. Each inner face 54 and 56 has formed thereinto a plurality of individual cube corner type retroreflective units 61 and 62, respectively. All units 61 in inner face 54 are arranged so as to be generally coplanar relative to one another, and similarly for all the units 62 in inner face 56, respectively. An inturned peripheral shoulder 57 and 58, respectively, extends about each body 49 and 51, and projects beyond its respective associated inner face 54 and 56. Each such shoulder 57 and 58 preferably and as here illustrated terminates in an outturned flange 68 and 69, respectively, to provide a mounting surface. Preferably, both bodies 49 and 51 have the same color in an individual reflector 60 construction. The surface area of outer face 52 is preferably from about 1.5 to 3.5 times larger than the surface area of outer face 53, though this ratio can vary greatly in practice without departing from the present invention.

Bodies 49 and 51 have their respective flanges 68 and 69 positioned against, and mounted to, base 46 and leg 47 of backing member 44, respectively. Any convenient mounting means for bodies 49 and 51 may be employed, such as an adhesive, or the like, but here ultrasonic welding is employed preferentially and as illustrated. During assembly, body 51 is first mounted to leg 47, and then body 49 is mounted to base 46. Flange 68 is provided with a spacing ear 71 integrally formed therewith which serves to locate and orient body 49 relative to backing member 44 and body 51 in a desired manner before ultrasonic welding (see FIG. 7).

Preferably, and as shown, integrally formed ribs 73 and 74 upstand from the opposed sides of base 46 and leg 47, respectively, and integrally formed rib 76 upstands from the forward edge of base 46. Ribs 73, 76 and 74 are joined end to end with one another integrally. Ribs 73, 74 and 76 and in rigidifying and strengthening backing member 74, and aid in protecting edge portions of bodies 49 and 51 from bumps or impacts.

The general nature and construction of cube corner type retroreflective units and reflectors utilizing same is well known; see, for instance, the disclosure contained in U.S. Pat. Nos. 3,894,786 or 3,893,747, or that in the Heenan and Nagel U.S. Pat. No. 3,541,606 and elsewhere.

In a reflector construction 60, when angle 55 is in the preferred range above indicated, the cube corner units 62 of retroreflective body 51 are preferably of the so-called standard type. Thus, the respective optical axes (not detailed) of the individual respective units 62 are preferably normal to the outer face 53 thereof, and retroreflective body 51 is then adapted to retroreflect light rays incident against face 53 through a solid cone angle 63 of up to about 25° to 30° around a perpendicular 64 to face 53, as those skilled in the art will appreciate. The cube corner retroreflective units in body 51 have optical axes which are parallel to one another and which are generally inclined at an angle of from about 0° to 15° with respect to a perpendicular 64 to the face 53 of body 51. Retroreflective body 51 is adapted to retroreflect light rays incident against face 53 up to about 50° relative to one side of the perpendicular 64.

In order to minimize the characteristic so-called clover-leaf pattern of retroreflection associated with retroreflection from a single group of standard cube corner units which are all similarly oriented, and to make such pattern more uniform and circular, it is preferred, but not necessary, to divide the units 62 into two equally sized groups, and to rotate the axes of the units of one group 180° with respect to the axes of the units of the other group. As shown in FIG. 1, in retroreflective body 51, such an arrangement is used so that one group 62A is formed in the inner face 56 in the upper half of the body 51 while another group 62B is formed in the inner face 56 in the lower half of the body 51.

Also, in reflector 60, the cube corner units 61 of retroreflective body 49 are preferably of the so-called wide angle type. Thus, the respective optical axes, illustrated by line 59, of the individual respective units 61 are inclined at an angle 66 of from about 20° to 35° (preferably 25° to 30°) with respect to a perpendicular 65 to outer face 52 of flattened retroreflective body 49. Thus, light rays within an included angle 94 of from about 65° to 75° to one side of perpendicular 65 to about 5° to 15° to the same side of perpendicular 65 striking face 52 are retroreflected. The orientation of angle 94 is such that the location of its greatest lateral or side projection is towards side 67 of body 49. Thus, when body 49 is mounted on base 46, as shown, for example, in FIGS. 4 and 6, the orientation of body 49 is such that body 49 is retroreflective of incident light rays striking against face 52 from locations lateral and outside of side 67 and from directions generally opposite to those from opposed locations beyond leg 47 and body 51.

If desired, each body 49 and 51 can have formed therein more than one group of cube corner retroreflective units. Each such group can have its optical axes of individual units all parallel to one another in each body 49 or 51. The axes of one such group can be rotated with respect to a second such group, for example, or the axes of one such group can be inclined at a different angle relative to a second such group within the angular relationships herein above indicated, or both, if desired.

Preferably a reflector such as reflector 60, has a base portion and a leg portion which are each rectangular in perimeter configuration. Also preferably, the leg portion has a transverse width measured from the acute angle formed between the leg portion and the base portion which is not more than about one-half the transverse width measured from such acute angle of the base portion in a reflector, such as reflector 60.

Any convenient mounting means or technique may be employed.

One technique for mounting a reflector 60 is to apply over the back surface 77 of base 46, an adhesive layer 78, comprised of, for example, a butyl rubber based pressure sensitive adhesive tape, or the like. Until the time of application, the exposed surface of layer 78 can be covered by a coated paper release sheet, or equivalent, if desired (removed and not shown). Layer 81 is an optional but not preferred adhesive cushioning layer applied between layer 78 and a concrete barrier marker 96 or the like. Adhesive mounting systems are presently preferred.

In a given reflector 60, the interrelationship between the vertical height 83 of body 51 above the face 52 of body 49 and the transverse distance 84 across the face 52 of body 49 is such that preferably a minimum predetermined specific intensity value for retroreflectivity in candelas per foot candle exists for reflector 60 with respect to incident and retroreflected light passing the forward tip edge 86 of body 49 at or along a negative angle 88 of predetermined value (such as −5°) relative to a tangent line 87 extending parallel to the surface of face 52, but perpendicularly to side 67 of body 49 which tangent line represents 0°. The exact angle (not shown) at which, for example, incident light rays at some predetermined such negative angle 88 strike the face 53 is unimportant so long as such minimum predetermined specific intensity value is achieved in fact, as those skilled in the art will understand. For example, at a negative angle 88 of −5° (presently preferred), a reflector 60 preferably has a minimum specific intensity value for retroreflectivity which is at least that shown in the following table:

TABLE II

| Color of bodies 49 and 51 | Specific intensity value in candela per foot candle |
|---|---|
| White | 10 |
| Red | 2.5 |
| Amber | 6 |
| Blue | 2.5 |

Also preferably in such a given reflector 60, at an angle 89 of predetermined value above 60°, but less than 90°, measured perpendicularly to tangent line 87 and to side 67 of body 49, a minimum predetermined specific intensity value for retroreflectivity in candelas per foot candle exists for reflector 60 with respect to incident and retroreflected light at or along such angle 89. For example, at a positive angle 89 of 75° (presently preferred), a reflector 60 preferably has a minimum specific intensity value for retroreflectivity which is at least that shown in the following table:

TABLE III

| Color of Bodies 49 and 51 | Specific intensity value in candelas per foot candle |
|---|---|
| White | 10 |
| Red | 2.5 |
| Amber | 6 |
| Blue | 2.5 |

In general, the relationship between the bodies 49 and 51 in a reflector 60 is so selected that, between about the 0° tangent line 87 and an angle 91 of 60° measured perpendicularly to tangent line 87 and to side 67 of body 49, reflector 60 is continuously retroreflective of incident light rays striking one or the other of faces 52 and 53, and such retroreflected light has a minimum intensity value as set forth in Table I above. Preferably, such a reflector 60 is continuously so retroreflective of incident light rays between about −5° and 75° (measured relative to tangent line 87) so that Tables I, II and III are satisfied.

Figure 6:
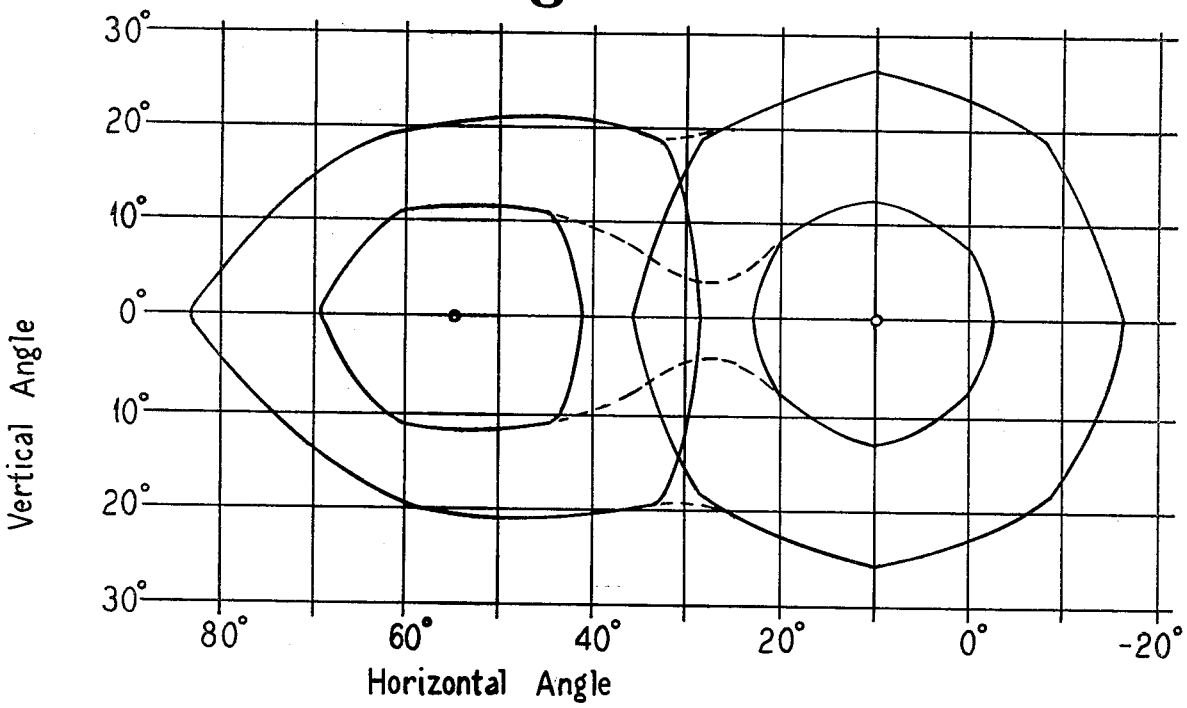
FIG. 6 is a plot in rectangular coordinates illustrating the manner in which light is retroreflected from respective ones of the two reflector-equipped surfaces utilized in the embodiment of FIGS. 1–4.

In FIG. 6, there is shown a representative plot in rectangular coordinates illustrating characteristic specific intensity values of retroreflected light from each of the bodies 49 and 51 of a reflector 60 at each of several different retroreflective light values, respectively. Thus, curves 91A, 91B, and 91C are representative of retroreflected light from body 49 at respective percentages of 100%, 30% and 10%, and curves 92A, 92B and 92C are representative at respective percentages of 100%, 30% and 10% of retroreflected light from body 51. Curves 91A and 92A are each a point. The retroreflection from each respective body 49 and 51 adds together in use of a reflector 60 producing composite curves illustratively connected by dotted lines in FIG. 6. Observe that the intersection of 0° horizontal angle represents the direction parallel to the tangent to the roadway at the point at which the reflector 60 is mounted. The body 51, here with standard cube corner optics of the cube corner type, has been tilted about 10° from a perpendicular (to a roadway).

Reflector 60 is fixedly mounted with layer 78 against the surface of a support 82, such as a guard fence, post, or the like, as desired. Preferably, reflector 60 is mounted in a permanent manner resistant to attack by weather, and the environment. When being mounted, reflector 60 is spatially oriented so that face 52 is generally parallel to a tangent to an adjacent roadway side edge portion while side 67 is generally perpendicular to the surface of the adjacent roadway. Thus, a reflector 60 as so mounted is viewable by the driver of a vehicle moving along such roadway continuously through an angle of from at least about −5° to 75° in relation to such tangent.

When reflector 60 is so mounted relative to a roadway, body 51 is facing substantially towards on-coming traffic but is tilted preferably about 10° into a roadway. Since body 51 incorporates standard retroreflective optical elements preferentially, there is thus approximately 25° of reflectivity on each side of a perpendicular to the face 53 so that the body 51 covers from about −15° to +35°, such angles being measured from a direction parallel to the tangent to the roadway at the point where each reflector 60 is mounted. Because the body 49 incorporates preferentially so-called wide angle cube corner type retroreflective optical units, and because the body 49 is mounted in a direction parallel to the flow of traffic, the wide angle optics peak here at approximately 35° to a normal or perpendicular to face 52 or approximately 55° from such tangent to such roadway. Reflection thus occurs predominantly in the region from about ±25° from such a 35° peak. Hence, while the standard units 62 are active to an angle of 35° into a roadway, the wide angle units 61 commence to become active at an angle of about 30° from the tangent to the roadway resulting in an approximate 5° overlap between the respective retroreflected light from body 49 and body 51. On an opposite side, the body 52 retroreflects 25° from the peak which is about 35° from a normal to the face 52, so, therefore, the body 49 is active to about 80° from the direction of the tangent to the roadway at the point where each reflector 60 is mounted approximately. Thus, the combined standard and wide angle reflector bodies, such as bodies 51 and 49 employed in reflector 60, are active from about −15° to such tangent to the roadway through an angle of about +80° to such tangent in a particularly preferred embodiment.

For a given reflector 60, duly mounted along the side of a road as on a barrier 96 or the like, the distance from a car moving along the road towards the reflector can be regarded as one leg of a triangle, and the distance from the car to the barrier can be regarded as another leg of the triangle. Thus, for various distances a number of triangles can be created, each triangle including an entrance angle. A value can be established for the specific intensity at a given entrance angle.

The respective curves of FIG. 6 also illustrate the importance of having individual retroreflective reflectors used in the practice of the system of the present invention have minimum specific intensity values for retroreflectivity. Values below those herein indicated can result in the driver of an on-coming vehicle not being able to see individual reflectors, particularly in the case of inclement weather, or possibly in a situation where a slight film of atmospheric contamination (dirt) has become lodged over the face of a reflector, such as can and routinely does occur under actual field use conditions for barrier marker reflectors, as those skilled in the art will approximate.

In place of reflector 60 one can employ other forms of retroreflective reflector means which have characteristics such as are generally above indicated. Thus, for example, referring to FIG. 11, an embodiment 60' of a reflector similar to reflector 60 in construction is provided with a layer 78' which is directly applied to a barrier 96'. The components shown in FIG. 11 are similar to those shown in FIG. 3, for example, and are similarly numbered but with the addition of prime marks thereto.

For another example, referring to FIGS. 8–10, there is seen an embodiment 60" of a reflector similar to reflector 60 in construction which is provided with wing-type dihedral integral flanges 201 and 202 for mounting reflector 60" to a guard rail 203 between a pair of adjacent convolutions 204 and 205 thereof. An adhesive, such as a self-curing epoxy resin or the like, is applied to outside surfaces of each flange 201 and 202 and the reflector 60" is manually set in place with the adjacent surface portions of guard rail 203 being in parallel relationship to the respective flanges 201 and 202. Apertures 206 defined in each flange 201 and 202 have tapered side walls so that any adhesive which oozes thereinto before setting when a reflector 60 is in place is, in effect, aiding in bonding a reflector 60" to an adjacent guard rail 203. For mounting purposes, the size and shape of the flanges 201 and 202 can vary widely, as can the size and location of any apertures 206 used, in any given embodiment.

Figure 5:
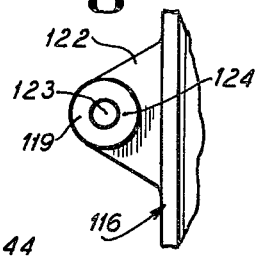
FIG. 5 is a fragmentary view of another embodiment of a reflector assembly illustrating one alternative mounting means therefor.
Figure 2:
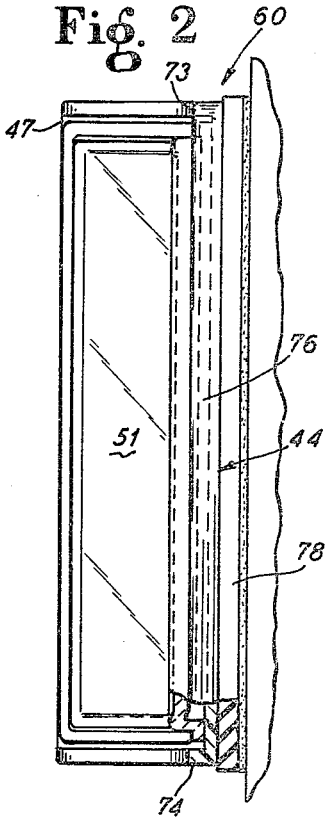
FIG. 2 is an end elevational view of the embodiment shown in FIG. 1, showing such embodiment mounted upon a surface.
Figure 4:
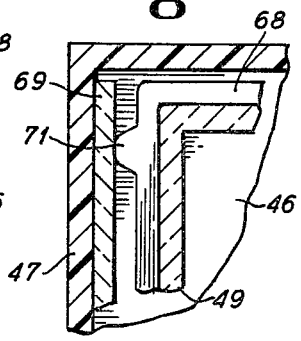
FIG. 4 is an enlarged fragmentary sectional view taken through the region IV-IV of the embodiment of FIG. 3.
Figure 3:
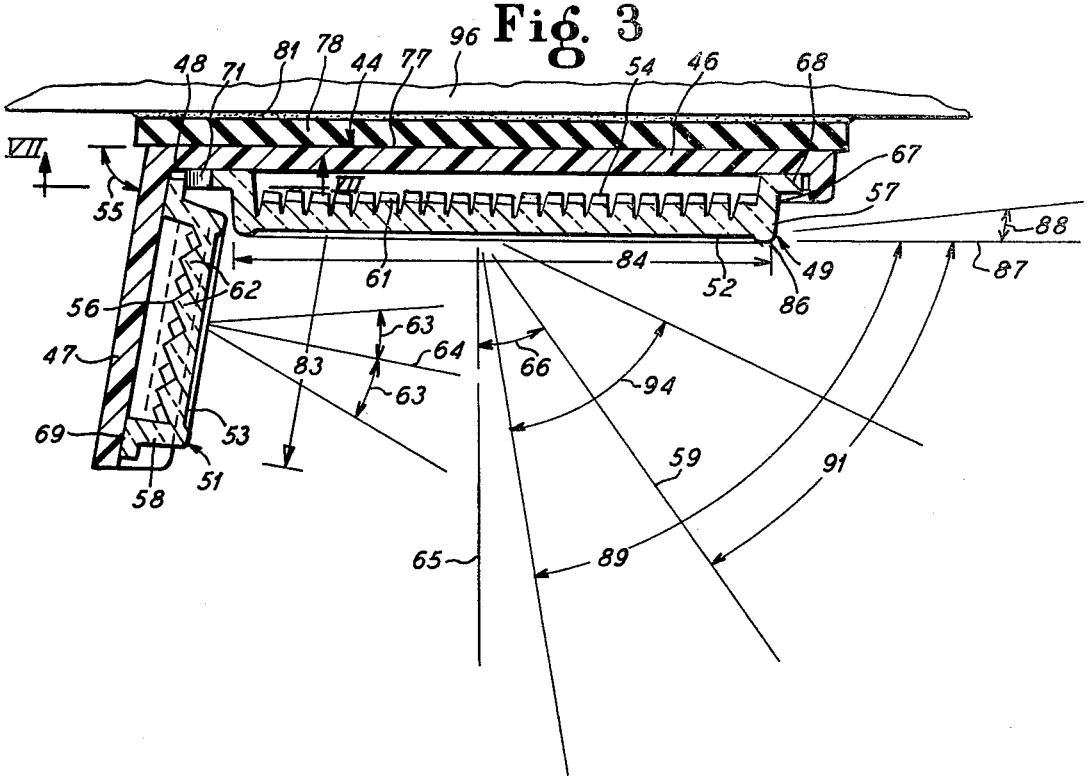
FIG. 3 is a transverse sectional view taken through a mid region of the embodiment shown in FIG. 1.

As shown in FIG. 5, mechanical mounting means can alternatively be employed for mounting reflector 116, which is similar to reflector 60 in construction. Here mounting flanges 122 (paired), each one of such pair being integral with a different end of reflector 116 terminate in thickened apertures 123 (one in each flange 122. A wet nut and bolt assembly 124 or the like can then be extended through each flange 122 to mount reflector 116 in a desired orientation at a given location.

Figure 7:
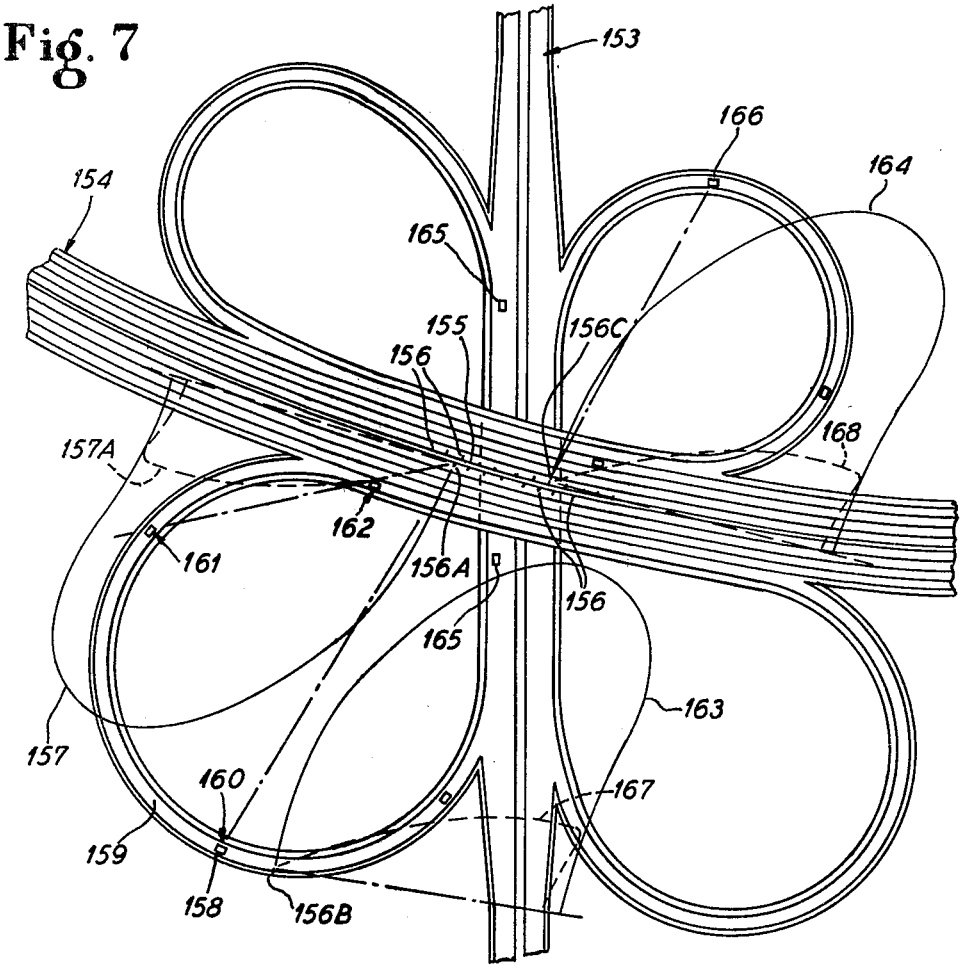
FIG. 7 is a diagrammatic plan view of an actual installation utilizing reflector assemblies of the type shown in FIGS. 1–4.

Referring to FIG. 7, there is seen an actual installation of a system of this invention which involves highway 53 and Palatine Road northwest of Chicago, Ill.; highway 53 being designated by the numeral 154, and Palatine Road being designated by the numeral 153. Reflectors each similar to reflector 60 and 60' are mounted on highway 154 on either side of the bridge abutment 155 each at a distance of about 30 inches vertically above the highway 154 surface. These reflectors are longitudinally spaced from one another successively at intervals of about 30 feet. There are 9 such reflectors on one side of the abutment 155 and 12 such reflectors on the opposing side thereof. For convenience here, these reflectors are designated by the number 156. Thus, the drivers of vehicles moving in opposed directions along highway 154 see the individual reflectors 156 at night time on their respective sides of the bridge abutment 155; each reflector 156 is viewable within an angle extending from about −15° to about +75°, as these angles are explained above, with 0° being a tangent to the highway 154.

Trace 157 is representative of retroreflectance from a single reflector designated 156A. The driver of a vehicle 158 entering highway 154 on cloverleaf 159 sees reflector 156A commencing at position 160. Such driver continues to see such reflector 156A thereafter continuously until the vehicle enters highway 154 and has almost moved past such reflector 156A. In contrast, when prior art reflectors replace reflector 154A, a trase such as 157A results, so that the same driver then does not see such prior art reflector until, on cloverleaf 159 he reaches location 161 at which location 161 such prior art reflector becomes retroreflectively visible to him. Also such driver loses sight of such prior art reflector well back thereof at position 162 at which location 162 the prior art reflector loses its retroreflectivity relative to such driver. There is thus a dramatic difference between these two reflector types. Obviously, all the other reflectors 156 are likewise each visible through a greatly expanded viewing angle compared to the prior art reflector.

Traces 163 and 164 similarly show the advantage of the present invention over the prior art in reference to for example, the driver of a vehicle 165 in relation to the trace 163, or, for another example, the driver of a vehicle 166 relative to the trace 164. The dotted lines 167 and 168 illustrate respective traces for prior art reflectors replacing reflectors 156B and 156C, respectively.

A reflector used in the present invention has two retroreflective regions. The total surface area of retroreflectivity associated with a reflector of this invention is under about 20 square inches, and more preferably under about 8 square inches.

A reflector used in the present invention should not retroreflect beyond about 90°, all as described herein, because, beyond 90° the retroreflected signal is entering the zone of a driver possibly driving in the wrong direction, against oncoming traffic, whereby the retroreflected signal would falsely indicate that he is driving in a correct direction. Thus, a marker which permits a signal in the wrong direction (beyond 90° to the tangent to the roadway) would create more of a hazard than the absence of a marker completely.

Although the teachings of our invention have herein been discussed with reference to specific theories and embodiments, it is to be understood that these are by way of illustration only and that others may with to utilize our invention in different designs or applications.

We claim:

1. A reflector for improved roadside barrier marking comprising (A) a backing member of integral, one piece, rigid construction having
(1) a flattened base portion, and
(2) an upstanding flattened leg portion along one edge of said base portion which is inclined in relation to said base portion at an acute angle ranging from about 60° to 85°, the faces of said base portion and said leg portion adjacent said acute angle being defined as inside faces, the area of said base portion being larger than the area of said leg portion, (B) two molded transparent flattened bodies, each having a flattened outer face and an inner face with a plurality of cube corner type retroreflective units formed thereinto and further having an inturned peripheral shoulder which upstands beyond its associated inner face,
(1) one of said flattened bodies being larger than the other thereof and being adapted to fit against the inside face of said base portion with the edge portions of said shoulder thereof engaged thereagainst,
(2) the other of said flattened bodies being adapted to fit against the inside face of said leg portion with the edge portions of said shoulder thereof contacted thereagainst,
(3) the outer surface area of said one flattened body being from about 1.5 to 3.5 times greater than the outer surface area of said other flattened body, (C) bonding means adhering such respective shoulder edge portions to said backing member at such locations of contact, (D) said flattened bodies in combination with said backing member being adapted to retroreflect incident light rays striking said outer faces thereof within an included angle of at least about 60° but less than about 90° where 0° is taken along a hypothetical line which is generally parallel to the outer face of said one flattened body and which is generally perpendicular to the outer face of said other flattened body and where said included angle is measured vertically upwards from said 0° line and outwardly from the outer face of said one flattened body, and (E) mounting means for mounting said reflector to a given support means with said respective outer faces being vertically oriented.

2. The reflector of claim 1 wherein said mounting means is mechanical.

3. The reflector of claim 2 wherein opposite side edge portions of said flattened base portion are each provided with an integrally formed flange which angularly projects upwardly and outwardly beyond the face of said one flattened body, the respective projection angles of said flanges being divergent with respect to one another, said flanges together being adapted to position and mount with adhesive means said reflector against a given guard rail member.

4. The reflector of claim 1 wherein said angle ranges from about 75° to 35°.

5. The reflector of claim 1 wherein said angle is about 80°.

6. The reflector of claim 1 wherein the cube corner type retroreflective units formed in the other of said flattened bodies have axes which are parallel to one another and which are inclined with respect to a perpendicular to the outer face of said other flattened body at an angle of from about 0° to 15° and wherein said cube corner type retroreflective units formed in said other flattened body have optical axes which are perpendicular to the outer face thereof.

7. The reflector of claim 6 wherein said cube corner type retroreflective units formed in said other flattened body are divided into two groups wherein such retroreflective units of one of such groups are, in effect, rotated 180° spatially with respect to such retroreflective units of the other of such groups.

8. The reflector of claim 1 wherein said base portion and said leg portion are each rectangular in perimeter configuration, and said leg portion has a transverse width measured from said acute angle of not more than about one-half the transverse width measured from said acute angle of said base portion.

9. The reflector of claim 1 wherein said two bodies are colored white, red, amber, or blue, and wherein retroreflected light therefrom within said included angle has a minimum specific intensity value for retroreflectivity which is at least that shown in the following table:

| Color of such two regions | Specific intensity value in candelas per foot candle |
|---|---|
| White | 20 |
| Red | 5 |
| Amber | 12 |
| Blue | 5 |

10. The reflector of claim 1 wherein the cube corner type retroreflective units of said one flattened body are of the wide angle type such that the respective optical axes of such retroreflective units are inclined at an angle of from about 20° to 35° with respect to a perpendicular to the outer face of said one flattened body with the included angle of retroreflectivity for light waves striking such outer face being so oriented that the location of greatest lateral projection of such angle of retroreflectivity is greatest toward the side of said one flattened body opposed to the side thereof adjacent said other flattened body.

11. The reflector of claim 1 wherein, at a negative angle of retroreflectivity of −5°, said other flattened body has a minimum specific intensity value for retroreflectivity which is at least that shown in the following table:

| Color of bodies 49 and 51 | Specific intensity value in candelas per foot candle |
|---|---|
| White | 10 |
| Red | 2.5 |
| Amber | 6 |
| Blue | 2.5 |

12. The reflector of claim 1 wherein, at a positive angle of retroreflectivity of 75°, said other flattened body has a minimum specific intensity value for retroreflectivity which is at least that shown in the following table:

| Color of bodies 41 and 51 | Specific intensity value in candelas per foot candle |
|---|---|
| White | 10 |
| Red | 2.5 |
| Amber | 6 |

-continued

| Color of bodies 41 and 51 | Specific intensity value in candelas per foot candle |
|---|---|
| Blue | 2.5 |

13. The reflector of claim 1 wherein said one flattened body has cube corner type retroreflective units of the wide angle type and said other flattened body has cube corner type retroreflective units of the standard type and the combined standard and wide angle cube corner type retroreflective units retroreflect from a negative angle of about −15° through a positive angle of about 80°.

14. The reflector of claim 1 having a total area of retroreflectivity associated therewith which is under about 20 square inches.

* * * * *